United States Patent [19]

Chap

[11] 4,456,125

[45] Jun. 26, 1984

[54] HANGABLE, STACKABLE BASKET

[75] Inventor: John P. Chap, Lemont, Ill.

[73] Assignee: Selfix, Inc., Chicago, Ill.

[21] Appl. No.: 407,113

[22] Filed: Aug. 13, 1982

[51] Int. Cl.[3] ..... A45F 3/14; B65D 21/00

[52] U.S. Cl. ..... 206/513; 200/19; 211/119; 211/126

[58] Field of Search ..... 220/1.5, 6, 7, 19; 206/511, 508, 512, 513; 211/113, 119, 188, 126

[56] References Cited

U.S. PATENT DOCUMENTS

| | | | |
|---|---|---|---|
| 3,082,879 | 3/1963 | Wilson | 206/512 X |
| 3,252,583 | 5/1966 | Walther et al. | 211/119 |
| 3,393,809 | 7/1968 | Brown et al. | 211/113 |
| 3,752,352 | 8/1973 | Senecal | 220/19 |
| 4,079,836 | 3/1978 | Stein et al. | 211/126 X |
| 4,361,234 | 11/1982 | Hawes et al. | 220/19 X |

FOREIGN PATENT DOCUMENTS

| | | | |
|---|---|---|---|
| 1558540 | 1/1980 | United Kingdom | 211/119 |

*Primary Examiner*—Steven M. Pollard

*Attorney, Agent, or Firm*—Dressler, Goldsmith, Shore, Sutker & Milnamow, Ltd.

[57] ABSTRACT

An improved, plastic-coated wire basket arrangement is disclosed which greatly facilitates convenient and versatile use of the basket. The basket comprises a plurality of interconnected first and second members which generally define the bottom, sides, and back of the basket. The basket further includes a pair of hanging members which readily permit the basket to be hung from an object for support, and which further permit vertical stacking and hanging of more than one basket together. The basket preferably includes at least one hook member disposed generally at the bottom of the basket which is arranged to cooperate with the rearwardmost portion of a like basket to further facilitate vertical stacking and hanging of the basket. In the preferred configuration, the basket is preferably configured so as to permit ready nesting of two or more baskets compactly and neatly.

12 Claims, 4 Drawing Figures

FIG. 1
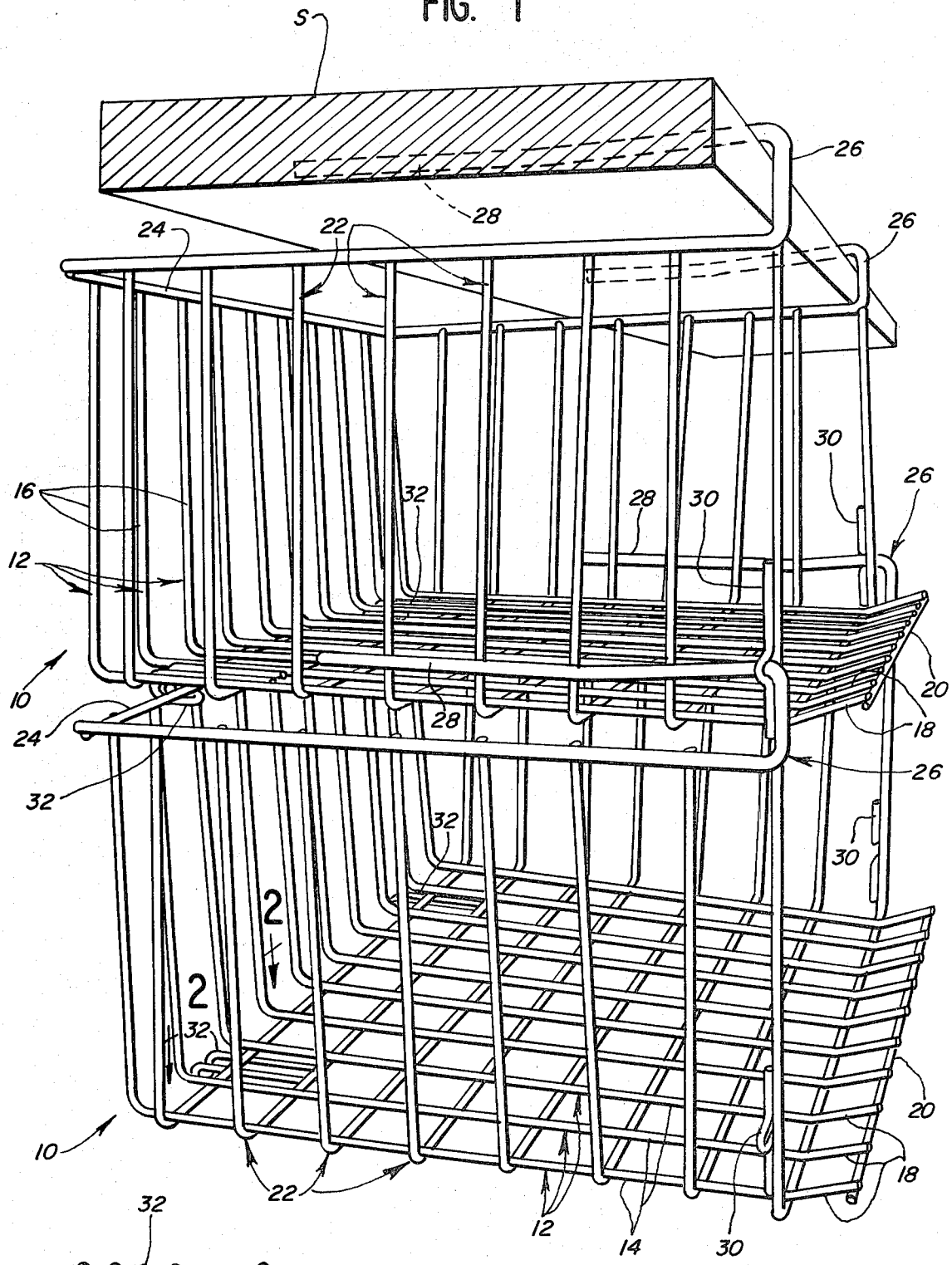
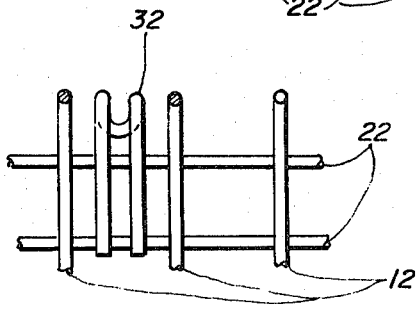
FIG. 2

FIG. 3
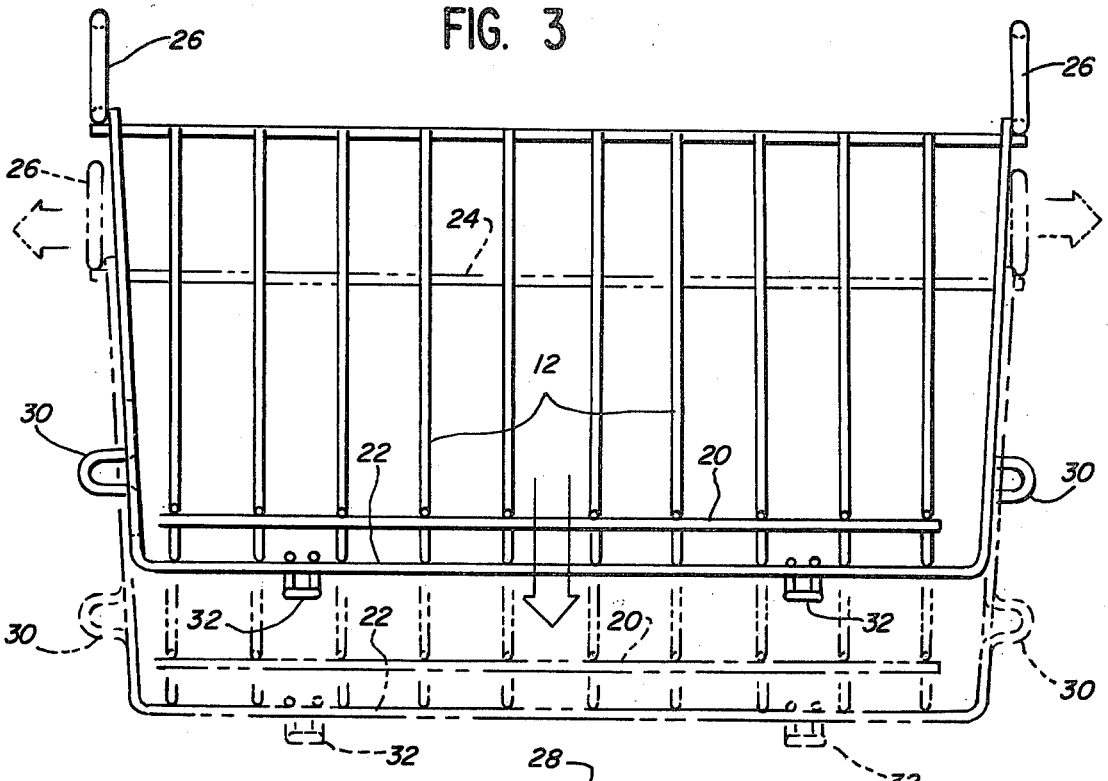
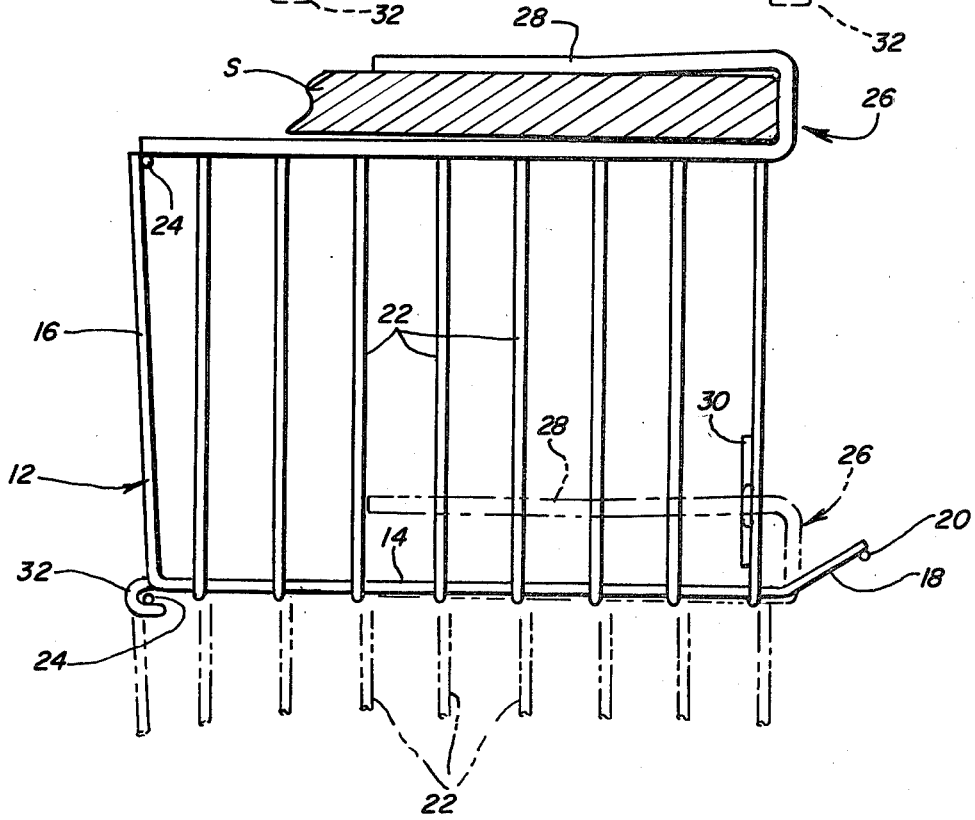
FIG. 4

HANGABLE, STACKABLE BASKET

TECHNICAL FIELD

The present invention relates generally to plastic-coated wire convenience items such as shelves and baskets, and more particularly to a plastic-coated wire basket arrangement which is configured for hanging, stacking, and nesting with like basket units.

BACKGROUND OF THE INVENTION

Household products formed from plastic-coated metal wire are extremely popular consumer items. These type of goods are available in a wide variety of configurations of shelves, racks, baskets, and like arrangements which facilitate convenient storage of articles where desired. The preferred plastic coating on these types of products provides an attractive, durable, corrosion-resistant finish which permits these types of products to be used in kitchen and bathroom areas, as well as throughout all parts of the home.

Basket-like coated wire products have proven particularly useful. These types of baskets typically include interconnected coated wire members which define an open-top basket having a bottom, lateral sides, and a back. The fronts of such baskets are usually open to facilitate placement and removal of articles into and from the basket.

The versatility of such baskets is enhanced when they are configured so as to facilitate easy mounting of the baskets, and to this end some baskets are constructed so as to permit hanging of the basket from a shelf or like object. The versality of these baskets is further enhanced when two or more baskets can be used in conjunction with each other. For example, some baskets include portions which facilitate vertical stacking of more than one basket. A further desirable feature is nestability, which permits compact storage of more than one basket in the home, as well as during shipment, storage, and retail display.

Heretofore, no known basket arrangements have been configured so as to provide all of the above-desired features, including hanging, stacking, and nesting. Thus, the introduction of a coated wire basket which provides these features in a straightforward manner greatly enhances the versatility of the use of the basket.

SUMMARY OF THE INVENTION

In accordance with the present invention, a preferably plastic-coated wire basket is disclosed which particularly facilitates convenient and versatile use of the basket, particularly when used in conjunction with one or more like baskets. The basket includes portions which facilitate hanging of the basket from a shelf or like object. The basket further includes portions which permit both vertical stacking and hanging of more than one basket. In the preferred embodiment, the basket is configured so as to readily permit nesting of more than one basket within each other easily and compactly.

The present basket preferably comprises plastic-coated metal wire for ease of economical fabrication, and for convenient, durable, and attractive use. The basket includes a plurality of laterally spaced, first members which generally define the bottom of the basket. The first members are preferably generally L-shaped, including lower portions which generally define the bottom of the basket, and upwardly extending portions which generally define the back of the basket.

The basket further includes a plurality of spaced apart, second members which are connected with the first members and extend generally transversely thereof. In the preferred embodiment, the second members are generally U-shaped, with their lower portions interconnected with the lower portions of the first members. The second members include generally upwardly extending portions which generally define a pair of laterally spaced sides of the basket. In the preferred configuration, the back and sides of the basket extend upwardly and outwardly of the bottom of the basket such that they are flared outwardly with respect to the vertical. This facilitates nesting of two or more baskets together.

The present basket further includes an arrangement for hanging the basket which is associated with the first and second members of the basket. The hanging arrangement preferably includes a pair of laterally spaced, generally J-shaped hanging members respectively connected to the upper end portions of the second members of the basket at the top of each side of the basket.

The hanging arrangement of the basket further includes means which facilitate vertical stacking and hanging of more than one basket. This is provided by a pair of receiving members which are adapted to respectively receive and releasably retain the hanging members of a like basket. Hanging and/or stacking of multiple baskets is further facilitated by the provision of at least one hook member generally disposed at the bottom, rear portion of the basket. The hook member is adapted to receive a laterally extending back member of a like basket, the back member generally defining the upper, rearward edge of the basket.

The cooperation of the various portions of one basket with the portions of one or more like baskets permits a plurality of baskets to be vertically hung or stacked with each other in a stable and secure fashion. The interconnections of the baskets are readily releasable so that the exact arrangement of a group of baskets can be easily altered. When the baskets are being stored or are otherwise not in use, they may be easily detached from one another and thereafter nested within each other in a compact and convenient manner.

Numerous other advantages and features of the present invention will become readily apparent from the following detailed description of the invention and embodiment thereof, from the claims and from the accompanying drawings in which like numerals are employed to designate like parts throughout the same.

BRIEF DESCRIPTION OF THE DRAWINGS

FIG. 1 is a perspective view illustrating a pair of vertically arranged baskets each configured in accordance with the present invention;

FIG. 2 is a view taken generally along lines 2—2 of FIG. 1;

FIG. 3 is a front elevational view illustrating the nesting feature of the present basket; and FIG. 4 is a side elevational view illustrating the hanging features of the present basket.

DETAILED DESCRIPTION

While the present invention is susceptible to embodiment in various forms, there is shown in the drawings and will hereinafter be described a presently preferred embodiment with the understanding that the present disclosure is to be considered as an exemplification of the principles of the invention and is not intended to limit the invention to the embodiment illustrated.

With reference now to the drawings, a pair of baskets 10 each configured in accordance with the present invention are illustrated. It will be noted that in FIGS. 3 and 4, one of the baskets 10 is illustrated in phantom line for purposes of clarity. For purposes of the present disclosure, reference will be made to one of the baskets 10 in describing the preferred configuration thereof, with the understanding that the present basket is particularly adapted for use with one or more like baskets.

Basket 10 preferably comprises plastic-coated metal wire members which are appropriately shaped to provide the basket with its desired configuration. The plastic coating may comprise vinyl or a like material which is suitably durable and corrosion-resistant, and which is typically available in a wide variety of colors for enhancing the aesthetic appeal of the basket. The basket 10 may be fabricated in accordance with known methods, typically comprising suitable interconnection of the various members of the basket such as by welding, with the entire arrangement thereafter plastic-coated.

As illustrated, basket 10 includes a plurality of generally parallel, laterally spaced, generally L-shaped first members each designated 12. Each first member 12 includes a lower, generally horizontal bottom portion 14, the portions 14 together generally defining the bottom of the basket 10. The members 12 each further include a generally upwardly and outwardly extending back portion 16, the portions 16 together generally defining the back of basket 10. If desired, each first member 12 may be provided with a forward portion 18 which extends slightly upwardly of the bottom of basket 10. A laterally extending front member 20 can be connected to each of the forward portions 18 of the first members 12 so that the basket 10 is provided with a lip to facilitate retention of articles within the basket.

The basket 10 further includes a plurality of spaced apart, generally parallel second members 22 which are each preferably generally U-shaped. In the illustrated embodiment, lower portions of second members 22 generally underlie and extend transversely of the bottom portions 14 of first members 12 to which members 22 are connected. Each second member 22 includes side portions which extend generally upwardly of the bottom of basket 10 to thereby generally define a pair of laterally spaced sides of the basket. As best illustrated in FIG. 3, the upper portions of second members 22 which provide the lateral sides of basket 10 preferably extend somewhat outwardly of the bottom of the basket i.e., they are flared outwardly with respect to the vertical. This facilitates nesting of basket 10 within a like basket.

While it will be appreciated that the exact configuration of first and second members 12 and 22 can be varied somewhat without departing from the principles of the present disclosure, the arrangement illustrated has proven to be easy to manufacture and convenient to use. In the preferred embodiment, the back of basket 10 is further defined by a back member 24 which extends laterally between the lateral sides of the basket. The back member 24 is preferably attached to the upper end portions of the back portions 16 of first members 12. Thus, back member 24 generally defines the rearwardmost upper edge of the basket 10.

In order to facilitate hanging of basket 10, as well as hanging and/or stacking of basket 10 with a like basket unit, basket 10 includes a pair of preferably generally J-shaped, rearwardly-opening hanging members, each generally designated 26. The hanging members 26 are respectively connected to the opposite upper portions of the second members 22 which define each one of the laterally spaced sides of the basket. Thus, each hanging member is generally disposed at the top portion of one of the lateral sides of the basket 10.

The preferred configuration of hanging members 26 as illustrated facilitates hanging of basket 10 from a shelf, designated S, or a like object for support. Preferably, the rearwardly extending upper portion 28 of each hanging member 26 is configured so as to include a portion which extends toward the lower portion of hanging member 26, with the remaining distal portion of upper portion 28 extending generally parallel to the lower portion of the hanging member to a free end. As best illustrated in FIG. 4, this preferred configuration facilitates firm, highly frictional engagement of the hanging members 26 with shelf S or a like support. This preferred configuration also permits the hanging members to readily fit supporting objects of varying dimensions, with the natural resiliency of the preferred coated wire construction providing the hanging members 26 with a biased, gripping action.

The hanging members 26 not only permit basket 10 to be hung from supporting objects, but also accommodate vertical stacking and hanging of more than one basket 10. To this end, basket 10 includes a pair of receiving members 30 each of which is adapted to respectively receive one of the hanging members 26 of a like basket 10. In the illustrated embodiment, receiving members 30 are suitably affixed to one of the generally U-shaped second members 22, and define therewith apertures which are adapted to receive the upper portions 28 of the hanging members 26 of another basket 10. While the arrangement illustrated has been found to provide secure and stable cooperation between hanging members 26 and receiving members 30, it will be appreciated that the exact configuration of the receiving members can be varied while they still provide the intended cooperation with the hanging members 26 of another basket.

Hanging and stacking of more than one basket 10 is further facilitated by the provision of one or more hook members 32. As illustrated, a pair of hook members 32 are provided on the basket 10 and are disposed generally at the rear of the bottom of the basket, such as by connection to one or more of the first members 12 and the second members 22. Each hook member 32 is generally forwardly opening, and each is adapted to releasably receive, in secure cooperative interengagement, the back member 24 of a like basket 10.

As will be appreciated, the provision of hanging members 26, receiving members 30, and hook members 32 readily facilitate vertical stacking and hanging of more than one basket 10. In order to interconnect one basket 10 to another, the hanging members 26 of one of the baskets are inserted through the apertures defined by receiving members 30 of another basket. The baskets are then moved generally horizontally and longitudinally relative to each other until the back member 24 of the lower of the baskets is received within hook members 32 of the upper of the baskets. When this has been accomplished, the baskets 10 are generally vertically aligned with each other, thus providing a neatly appearing and relatively compact storage arrangement. Depending upon the intended use, the two or more baskets may be positioned atop a suitable surface so that the baskets are stacked upon each other, with their cooperative interengagement maintaining them in relative position in a stable fashion. Alternately, the upper of the baskets can be hung from a suitable support such as shelf S by its hanging members 26, with one or more baskets 10 stably supported thereunder by cooperation of hanging members 26 with receiving members 30, and back member 24 with hook members 32. Clearly, the present basket arrangement greatly facilitates its versatility of use.

If it is desired to store or otherwise render a plurality of baskets 10 in a more compact arrangement, the basekts may be readily nested as illustrated in FIG. 3. This is easily accomplished by positioning one of the baskets 10 within a like basket slightly forwardly thereof. The inner of the baskets may then be moved downwardly into substantially fully nested relation with the other basket. As illustrated by the phantom arrows in FIG. 3, the lateral sides of the lower of the baskets may be easily flexed outwardly due to the resilient nature of the preferred coated wire construction, thus permitting the inner of the baskets 10 to be moved downwardly until the bottoms of the nested baskets are generally adjacent to each other. As noted, the preferably outwardly flared configuration of the sides and back of the basket readily facilitate nesting of more than one basket in this manner.

Thus, a plastic-coated wire basket is disclosed which includes features which readily permit hanging of the basket from an object, as well as hanging, stacking, and nesting of the basket with one or more like baskets. These features greatly facilitate convenient and versatile use of the basket, and readily permit users of the basket to "customize" a suitable multiple-basket arrangement to their particular needs.

From the foregoing, it will be observed that numerous variations and modifications may be effected without departing from the true spirit and scope of the novel concept of the present invention. It will be understood that no limitation with respect to the specific apparatus illustrated herein is intended or should be inferred. It is, of course, intended to cover by the appended claims all such modifications as fall within the scope of the claims.

What is claimed is:

1. A basket adapted to hold articles, comprising:

a plurality of laterally spaced, first members generally defining the bottom of said basket;

a plurality of spaced apart, second members connected with said first members, each including portions extending generally upward of the bottom of the basket and generally defining a pair of laterally spaced sides of said basket; and hanging means associated with said first and second members whereby said basket is adapted to be hung from an object by said hanging means, said hanging means being adapted to cooperate with the hanging means of a like basket to permit vertical stacking and hanging of more than one basket, said hanging means comprising a pair of laterally-spaced, rearwardly-opening hanging member means respectively disposed at the upper portions of the spaced sides of said basket, said hanging member means being adapted to receive said object for hanging said basket therefrom by moving said basket generally horizontally and rearwardly, said hanging means further comprising means for receiving said hanging member means of said like basket for achieving vertical stacking and hanging of more than one basket.

2. The basket in accordance with claim 1, wherein said first and second members are configured so as to be adapted to permit substantial nesting of like baskets.

3. The basket in accordance with claim 1, wherein said portions of said second members are flared outwardly with respect to the vertical to permit substantial nesting of like baskets.

4. The basket in accordance with claim 1, wherein said receiving means comprises a pair of eyelet means respectively disposed at each of the laterally spaced sides of the basket for receiving said hanging member means of said like basket to achieve said vertical stacking and hanging of more than one basket.

5. The basket in accordance with claim 1, wherein said hanging means further comprise a back member extending laterally between the lateral sides of said basket, said back member generally defining the rearwardmost upper edge of said basket, and means disposed generally at the bottom of said basket adapted to receive the back member of a like basket for facilitating vertical hanging and stacking of more than one basket.

6. The basket in accordance with claim 5, wherein said hanging member means each includes an upper portion extending generally rearwardly of said basket to a free end, and said back member receiving means comprises at least one forwardly opening hook member, whereby generally horizontal, longitudinal movement of the basket relative to said like basket permits said hook member to receive the back member of the like basket and permits said hanging member receiving means to receive the hanging member means of the like basket.

7. The basket in accordance with claim 5, wherein said basket comprises plastic-coated metal wire.

8. A hangable, stackable basket, comprising:

a plurality of laterally spaced, generally L-shaped first members generally defining the bottom and the back of said basket;

a plurality of spaced apart generally U-shaped second members connected with said first members, each including portions extending generally upwardly of the bottom of the basket to generally define a pair of laterally spaced sides of the basket;

a back member extending laterally between the sides of the basket connected to the upper end portion of each of said first members;

a pair of laterally spaced, generally J-shaped, rearwardly opening hanging members respectively connected to said second members at the top of each side of the basket, each hanging member including an upper portion extending generally rearwardly to a free end;

means generally disposed on each side of said basket adapted to respectively receive the hanging members of another like basket, and means generally disposed on the bottom of the basket adapted to receive the back member the like basket, thereby accommodating vertical stacking and hanging of more than one basket.

9. The basket in accordance with claim 8, wherein the sides and the back of said basket extend outwardly with respect to the bottom of the basket to permit substantial nesting of like baskets within each other.

10. The basket in accordance with claim 9, wherein said back member receiving means comprises at least one forwardly-opening hook member.

11. The basket in accordance with claim 10, wherein each said first member includes a forward portion which extends upwardly and outwardly with respect to the bottom of the basket to define a basket lip.

12. The basket in accordance with claim 8 or 9, wherein said basket comprises plastic-coated metal wire.

* * * * *